US008020549B2

(12) United States Patent
Huber et al.

(10) Patent No.: US 8,020,549 B2
(45) Date of Patent: Sep. 20, 2011

(54) SELF-ALIGNING TELESCOPING DOWNDRAFT VENTILATOR ASSEMBLY

(75) Inventors: John J. Huber, Delafield, WI (US); Richard C. Hochschild, Jr., Grafton, WI (US); Gene Goetz, Waukesha, WI (US)

(73) Assignee: Western Industries, Inc., Watertown, WI (US)

( * ) Notice: Subject to any disclaimer, the term of this patent is extended or adjusted under 35 U.S.C. 154(b) by 150 days.

(21) Appl. No.: 12/361,987

(22) Filed: Jan. 29, 2009

(65) Prior Publication Data

US 2009/0137201 A1 May 28, 2009

Related U.S. Application Data

(63) Continuation-in-part of application No. 11/120,124, filed on May 2, 2005, now Pat. No. 7,836,877.

(51) Int. Cl.
*F24C 15/20* (2006.01)
*G07F 11/02* (2006.01)

(52) U.S. Cl. ..... 126/299 R; 126/299 D; 126/300; 126/312; 126/299 E

(58) Field of Classification Search ..... 126/299 R, 126/299 D
See application file for complete search history.

(56) References Cited

U.S. PATENT DOCUMENTS 3,381,927 A * 5/1968 Stamates ..... 248/429
4,200,280 A * 4/1980 Goodwin ..... 482/98
4,501,260 A 2/1985 Grace
4,562,827 A 1/1986 Cerola
4,736,729 A 4/1988 Beach
4,750,470 A 6/1988 Beach et al.
4,784,114 A * 11/1988 Muckler et al. ..... 126/299 E
4,934,337 A 6/1990 Falk
4,945,891 A 8/1990 Cecil
4,951,646 A 8/1990 Dickmann et al.
5,000,160 A 3/1991 Dunlop et al.
5,062,410 A * 11/1991 Sarnosky et al. ..... 126/299 D
5,119,802 A 6/1992 Cherry et al.
5,158,068 A 10/1992 Pickering
5,190,186 A * 3/1993 Yablans et al. ..... 221/124
5,213,091 A 5/1993 Beach
5,279,279 A 1/1994 White
5,287,799 A 2/1994 Pickering et al.
5,301,653 A 4/1994 Gerdes et al.
5,325,842 A 7/1994 Beach et al.
5,566,644 A * 10/1996 Beery ..... 119/448

(Continued)

OTHER PUBLICATIONS

Non-Final Office Action dated Dec. 12, 2008 for U.S. Appl. No. 11/120,124, filed May 2, 2005; first named inventor John M. Gagas.

(Continued)

*Primary Examiner* — Steven B McAllister
*Assistant Examiner* — Nikhil Mashruwala
(74) *Attorney, Agent, or Firm* — Boyle Fredrickson, S.C.

(57) ABSTRACT

A telescoping downdraft ventilator with a system for self-aligning a vent within a housing is provided. The telescoping downdraft ventilator of the present invention comprises a housing with a track, a vent sized to fit within the housing, a drive assembly that moves the vent along the track, and a guide attached to the vent for engaging the track, wherein the guide is operably coupled with a biasing element. In one embodiment, a pair of guides is respectively coupled with pair of compression springs and is positioned on opposite sides of the vent along a line that is substantially perpendicular to a pair of tracks.

15 Claims, 7 Drawing Sheets

U.S. PATENT DOCUMENTS

| | | | | |
|---|---|---|---|---|
| 5,577,490 | A | 11/1996 | Overton, Jr. | |
| 5,690,093 | A | 11/1997 | Schrank et al. | |
| 6,119,680 | A | 9/2000 | Barritt | |
| 6,168,378 | B1 | 1/2001 | Craw et al. | |
| 6,276,358 | B1 | 8/2001 | Brin, Jr. et al. | |
| 6,293,276 | B1 | 9/2001 | Owens et al. | |
| 6,455,818 | B1 | 9/2002 | Arntz et al. | |
| 6,484,713 | B1 * | 11/2002 | Schmitt et al. | 126/299 R |
| 6,501,053 | B2 | 12/2002 | Becker et al. | |
| 6,575,157 | B1 | 6/2003 | Shaver | |
| 6,647,978 | B1 * | 11/2003 | Khosropour et al. | 126/299 R |
| 6,841,760 | B2 | 1/2005 | Whipple, Jr. | |
| 7,263,989 | B2 | 9/2007 | Yamauchi et al. | |
| 2002/0189798 | A1 | 12/2002 | Jacobs | |
| 2003/0226560 | A1 | 12/2003 | Shekarri | |
| 2006/0176654 | A1 * | 8/2006 | Kfoury | 361/681 |

OTHER PUBLICATIONS

Final Office Action dated Jun. 26, 2008 for U.S. Appl. No. 11/120,124, filed May 2, 2005; first names inventor John M. Gagas.

Non-Final Office Action dated Apr. 2, 2008 for U.S. Appl. No. 11/120,124, filed May 2, 2005; first named inventor John M. Gagas.

Non-Final Office Action dated Sep. 27, 2007 for U.S. Appl. No. 11/120,124, filed May 2, 2005; first named inventor John M. Gagas.

* cited by examiner

SELF-ALIGNING TELESCOPING DOWNDRAFT VENTILATOR ASSEMBLY

CROSS-REFERENCE TO RELATED APPLICATION

This application claims priority from, and is a continuation-in-part of, U.S. Ser. No. 11/120,124 filed May 2, 2005, now U.S. Pat. No. 7,836,877.

BACKGROUND OF THE INVENTION

1. Field of the Invention

The present invention relates in general to the field of downdraft ventilators for use in conjunction with a cook top. More particularly, the present invention relates to a telescoping downdraft ventilator assembly having a system for self-aligning a moveable vent within a housing.

2. Discussion of the Related Art

Telescoping downdraft ventilators are well known to those skilled in the art. A conventional telescoping downdraft ventilator typically includes a housing, e.g., usually positioned behind a cook top, and a vent that is extendable above the housing to remove contaminated air from a cook top. When not in use, the vent is usually stored in the housing below the cook top. Further, the ventilator typically includes a fan for moving air through the system and a drive assembly for raising and lowering the vent with respect to the housing.

One problem with prior designs is that oftentimes the vent is not centered within the housing. This may occur if the vent is not evenly balanced, or if the lifting force provided by the drive assembly is uneven. Thus, undesired friction and/or resistance may occur between the vent and the housing or other components when raising and lowering the vent, which may in turn cause excessive wear and tear on the drive assembly and/or other components eventually leading to failure of the components and inoperability of telescoping downdraft ventilator.

What is needed therefore is a system for use in conjunction with a telescoping downdraft ventilator that centers the vent within the housing and reduces undesired friction and resistance during the raising and lowering operation.

SUMMARY AND OBJECTS OF THE INVENTION

By way of summary, one object of the present invention is to provide a telescoping downdraft ventilator having a system for centering or aligning the vent within the housing. Another object of the present invention is to reduce degradation of the drive assembly by providing a smoother raising and lowering operation. A still further object of the invention is to provide a downdraft ventilator having a system that can accommodate for uneven top and/or side loading forces. Yet another object of the present invention is to provide an apparatus that has one or more of the characteristics discussed above but which is relatively simple to manufacture and assemble using a minimum of equipment.

In accordance with one aspect of the present invention, these objects are achieved by providing a telescoping downdraft ventilator with a housing having a track. A vent is dimensioned to fit within the housing. A drive assembly is operably coupled with the vent and a guide is attached to the vent for engaging the track. The guide is operably coupled with a bias element that biases the guide away from the vent.

In accordance with another aspect of the present invention, these objects are achieved by providing a telescoping downdraft ventilator that has a housing, a vent sized to fit within the housing, and a drive assembly for vertically moving the vent with respect to the housing. The vent is preferably biased toward the center of the housing In accordance with a further aspect of the present invention, the telescoping downdraft ventilator has a housing having a first track and a second track on opposite sides of the housing. Here, the tracks are substantially parallel to one another. A vent is configured to travel along the first and second track. For example, a first guide and a second guide are attached to opposite sides of the vent. The first guide engages the first track and the second guide engages the second track. Further, the first guide and second guide are aligned along a line substantially perpendicular to the first track and the second track and each guide is coupled with a compression spring.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1A:
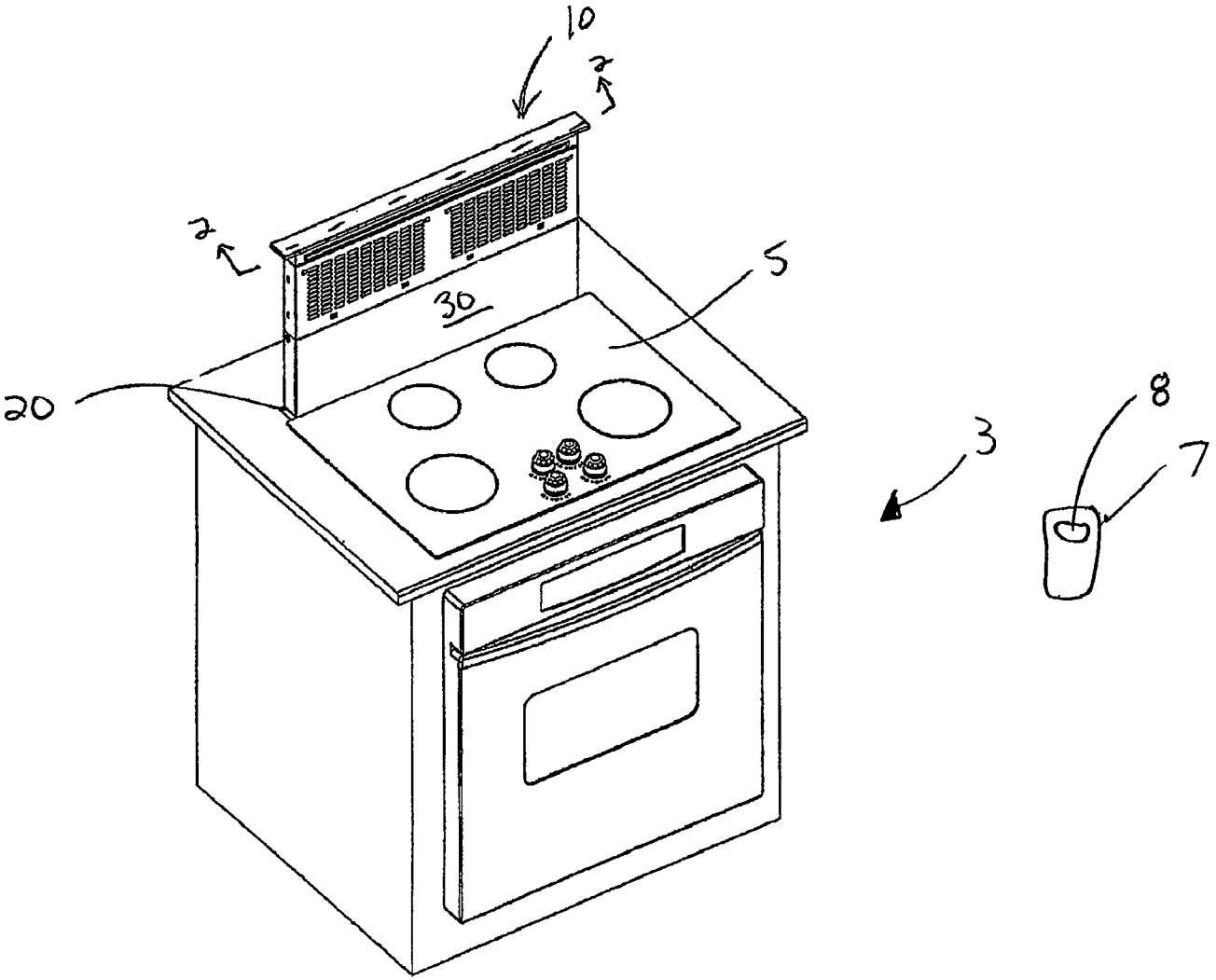
FIG. 1A illustrates a telescoping downdraft ventilator of the present invention coupled to a cook top.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The telescoping downdraft ventilator of the present invention generally includes a system that centers or aligns the vent within the housing. This is preferably accomplished by using one or more guides that are biased away from the vent and toward the housing, e.g., by employing a compression spring. More preferably, the guides are aligned along a line that is substantially perpendicular to the direction of movement of the vent. Thus, the force exerted by the compression springs on either side of the vent centers the vent within the housing. This centering or self-aligning effect is desirable because it facilitates a smoother raising and lowering operation, which may in turn reduce the amount of resistance experienced by a drive assembly and thus increase the lifespan of the drive assembly.

2. Detailed Description of Preferred Embodiments

Figure 1B:
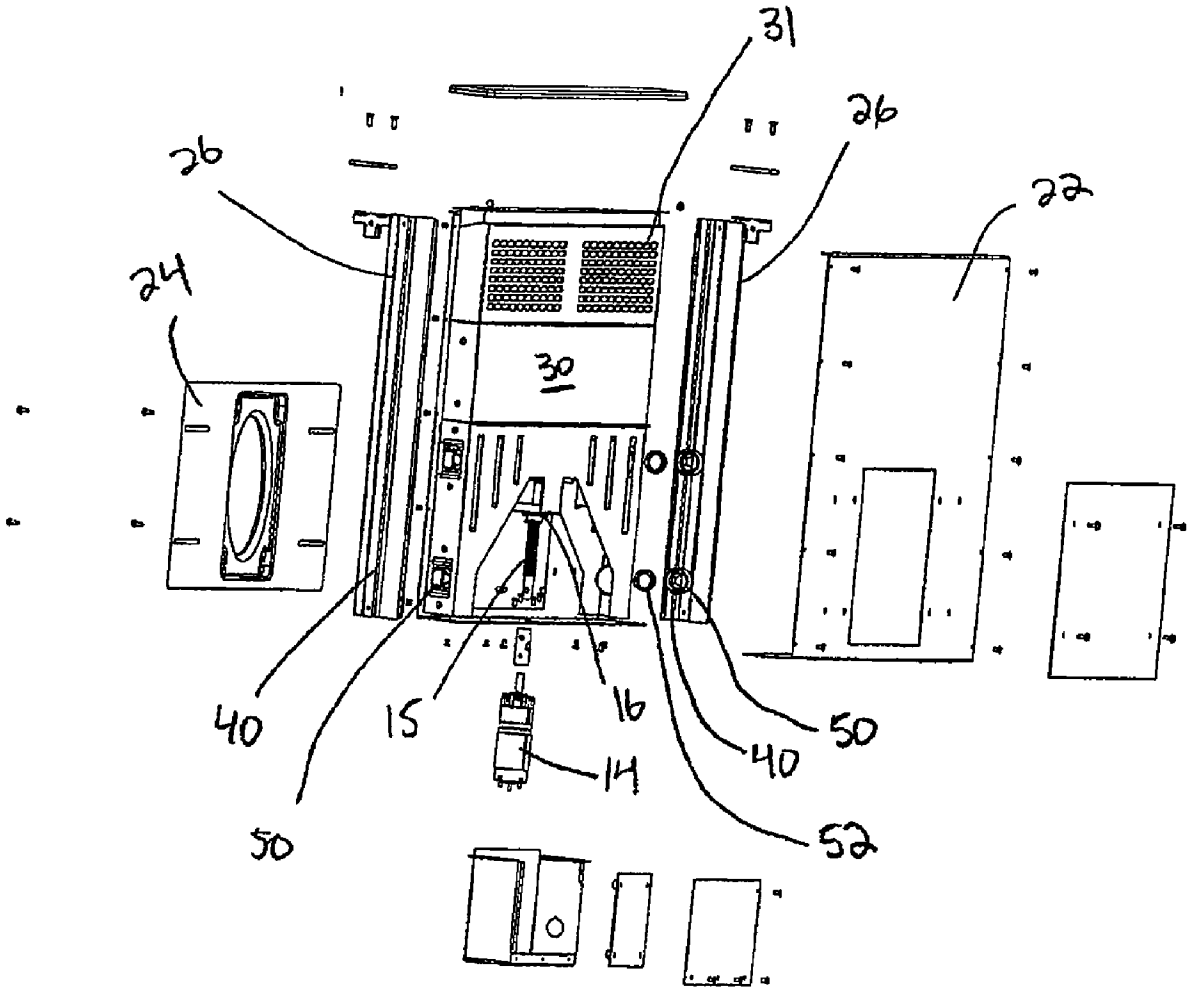
FIG. 1B illustrates an exploded perspective view of one embodiment of a telescoping downdraft ventilator of the present invention.
Figure 2:
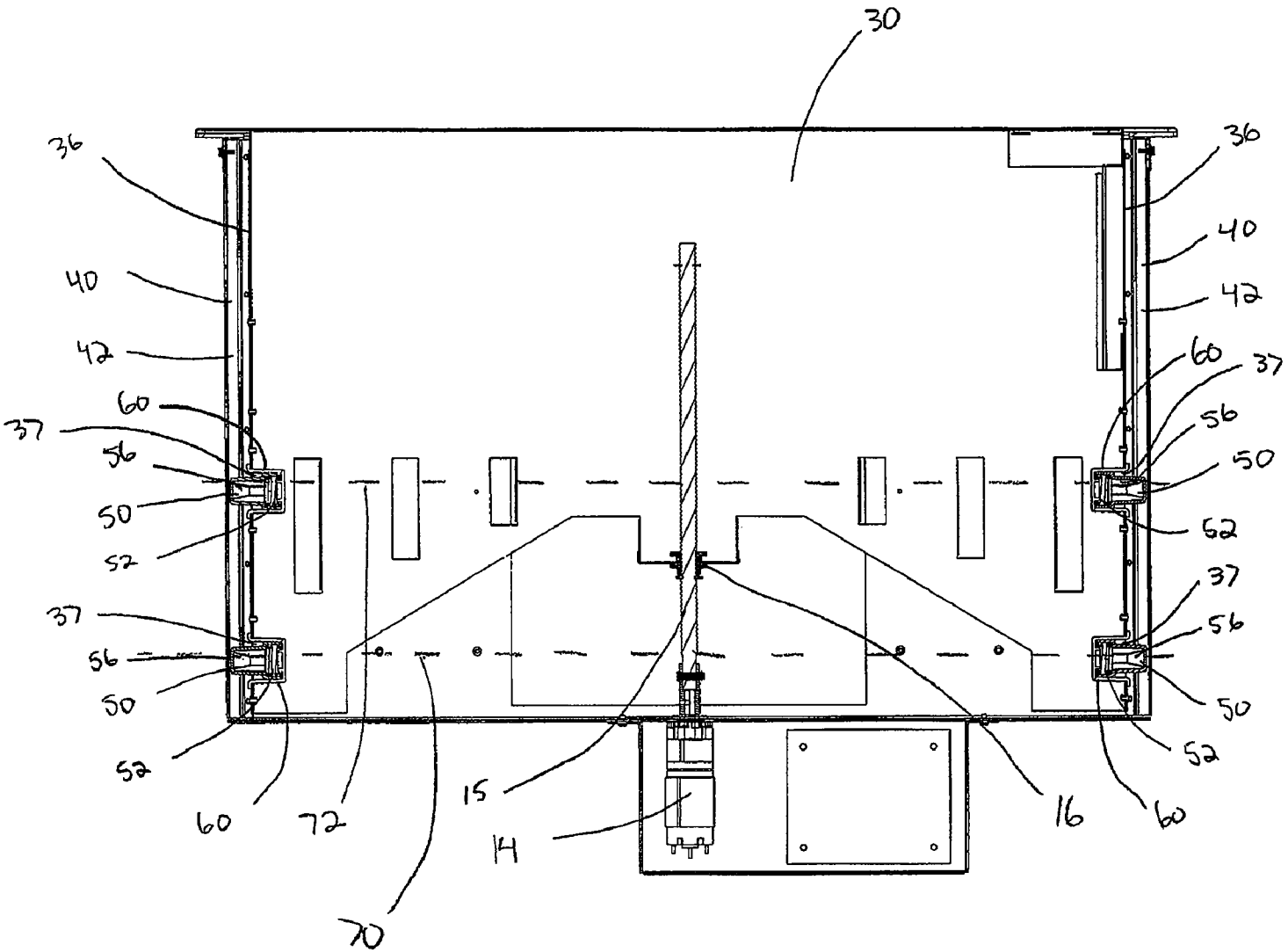
FIG. 2 illustrates a cross-sectional view of the downdraft ventilator of the embodiment of FIG. 1A along the line 2-2.

The present invention and its components are shown in FIGS. 1A-9. A self-aligning telescoping downdraft ventilator 10 in accordance with the present invention is shown in FIGS. 1A-2 attached to a stove 3 and having a cook top 5. A remote control with a screen 8 may be provided for remotely controlling the up and down movement of the ventilator 10. A standard telescoping downdraft ventilator 10 that typically includes a housing with a movable vent is well-known to those skilled in the art. See, e.g., pending applications U.S. Ser. Nos. 11/120,124 and 11/838,621, the entire contents of which are expressly incorporated by reference herein. Therefore a detailed description thereof is not necessary to fully understand the present invention, which is directed to novel improvements in an alignment system for centering the vent within the housing.

Referring now to the drawings, FIGS. 1B and 2 show one embodiment of the telescoping downdraft ventilator 10 of the present invention. Generally speaking, the downdraft ventilator 10 comprises a housing 20 and a vent 30 that fits within the housing 20. The vent 30 typically contains one or more fans 12 for drawing air into the system, moving air through the system, and exhausting air out of the system. See FIGS. 8 and 9.

The housing 20 preferably has a front panel 22, a rear panel 24 and two side panels 26. These components may be integral with the housing 20, or more preferably, they may be separate components secured together using any suitable fastener, e.g., bolts, rivets or screws. The front panel 22, rear panel 24 and side panels 26 preferably combine to form a housing 20 having a rectangular cross section, with the length preferably being substantially greater than the width. In one embodiment, the housing preferably has a height of about 24 inches, width of about 30 inches, and depth of about 2 inches. Such dimensions allow for positioning the housing 20 between a cook top and a wall, which is a typical configuration for a downdraft ventilator 10. See FIG. 1A. The housing 20 may be constructed out of any suitable material, and preferably it is made from galvanized steel.

Figure 6:
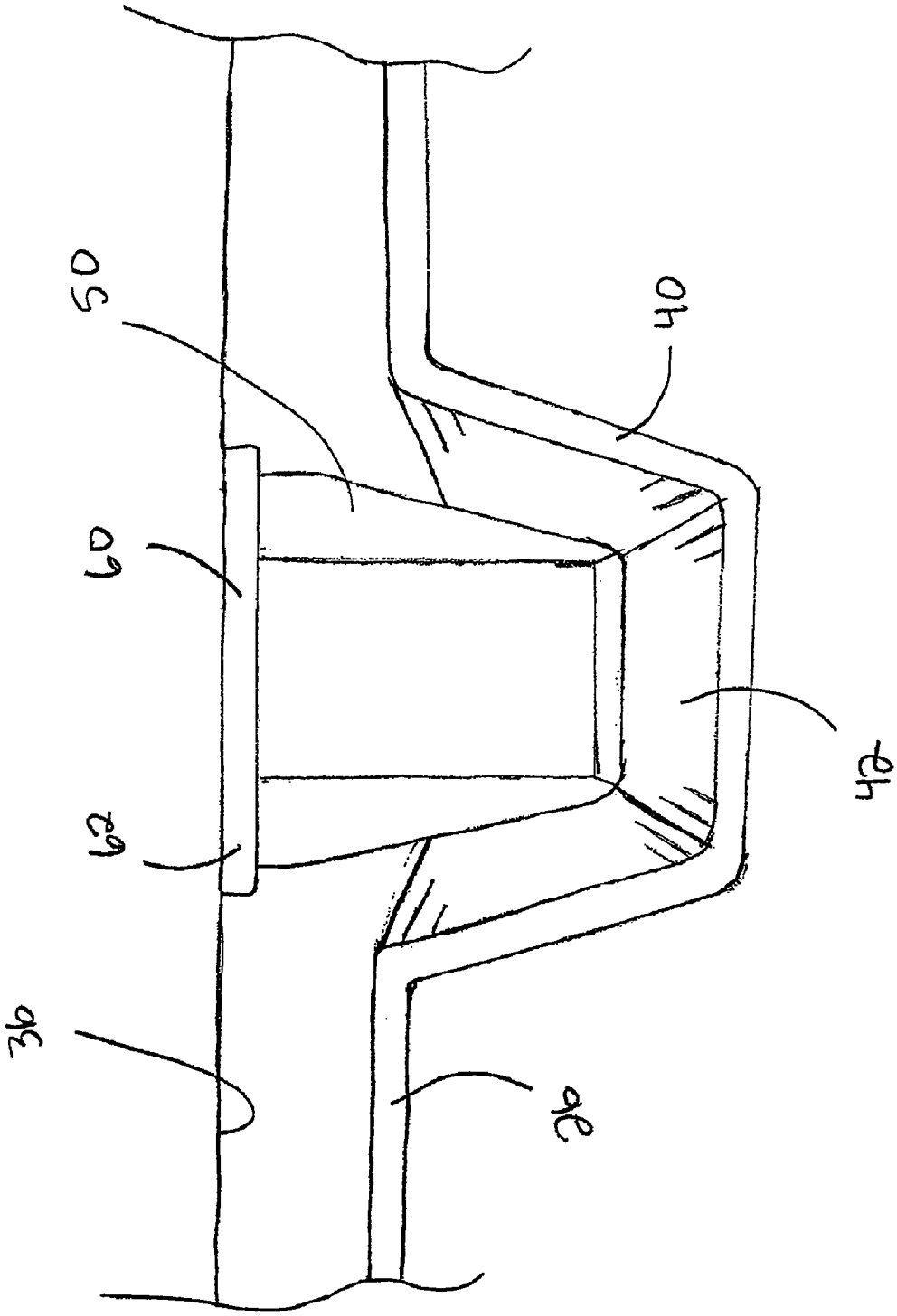
FIG. 6 illustrates a top view of a guide and a track of the embodiment of FIG. 1B.

As shown in FIG. 6, the side panels 26 of the housing are configured to form tracks 40. The tracks 40 are substantially parallel to one another and are substantially perpendicular to the front panel 22 and rear panel 24 of the housing 20, i.e., to the generally rectangular cross-section of the housing 20. Alternatively, each track 40 may be a separate structure attached to a side panel 26 of the housing. However, as shown in FIG. 6, it is preferred that the tracks 40 are formed by the side walls 26, which may reduce the amount of material needed to form the housing 20, eliminate manufacturing steps, and lower the cost of production. A variety of materials may be used to form the track 40, and preferably it is made from stainless steel.

Each track 40 includes a channel 42 for guiding the vent 30 as it is raised and lowered with respect to the housing 20. The channel 42 may be any shape that will help to guide the vent 30 within the housing 20, e.g., as shown in FIG. 6, the channel 42 preferably has a trapezoidal cross-section. This preferred shape for the channel 42 may provide for some slight lateral movement of the vent 30 while it is being raised and lowered, which may in turn allow for a more smooth raising and lowering operation. The inner surface 44 of the channel 42 is preferably smooth to minimize resistance or friction while the vent 30 is raised or lowered. The channel 42 may be lubricated, e.g., on the inner surface 44, to further reduce resistance or friction.

As shown in FIG. 1B, the vent 30 is preferably comprised of a front wall 32, a rear wall 34 and two opposing side walls 36. As with the housing 20, these vent components may be integral with the vent 30, or more preferably, they may be separate components secured together using any suitable fastener, e.g., bolts, rivets or screws. The vent 30 is sized to fit within the housing 20, i.e., the vent 30 is substantially contained within the housing 20 while not in use. However, the vent 30 partially extends out of the housing 20 and over the cook top 5 when the ventilator 10 is in use. See, e.g., FIG. 1A. The vent 30 preferably has a height of about 9 inches to about 15 inches, width of about 29 inches, and depth of about 1½ inches.

As mentioned, the vent 30 is configured to engage the tracks 40, which guide the vent 30 as it is moved, e.g., raised and lowered, with respect to the housing 20. Preferably, as shown in FIG. 2, the vent 30 has two guides 50 adjacent a respective side wall 36 for engaging the tracks 40 within the housing 20, i.e., each side wall 46 is coupled with a guide 50 for engaging one of the tracks 40. Each guide 50 has a shape that is complementary to the shape of the channel 42 of the track 40 to preferably provide a close fit between the guide 50 and the channel 42 while still allowing for relatively easy movement of the guide 50 through the channel 42. The guide 50 may be made of any suitable material, and preferably it is made from a smooth, hard plastic, e.g., Acetal.

Each guide 50 is biased away from the vent 30 and toward the housing 20, e.g., the guide 50 is preferably biased toward a track 40 engaged by the guide 50 along a line that is substantially perpendicular to the track 40. Thus, by positioning a pair of guides 50 along a line 70 that is substantially perpendicular to the tracks 40, the pair of guides 50 will help to vertically align the vent 30 within the housing 20, i.e., the system will be self-aligning. Additional guides 50, preferably arranged in pairs as described above, may be included.

The preferred biasing element for each guide is a compression spring 52. The compression spring 52 is configured with the guide 50 and the vent 20 so that the compression spring 52 exerts a force on the guide 50 that is substantially perpendicular to the side wall 36 of the vent 30 and toward the track 40 of the housing 20. The compression spring 52 may be made of any suitable material, and preferably it is made from steel. Other examples of a biasing element that may be used include but are not limited to elastomeric springs, Bellville springs, beam springs, torsional springs or air springs.

Figure 3:
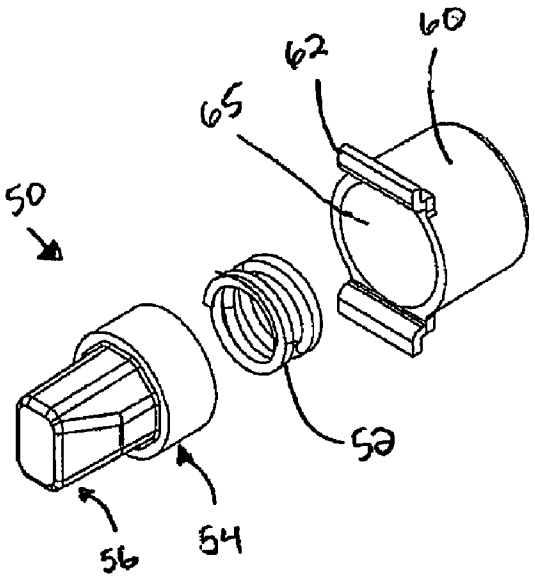
FIG. 3 illustrates an exploded view of a guide/insert assembly of the telescoping downdraft ventilator of the present invention.
Figure 4:
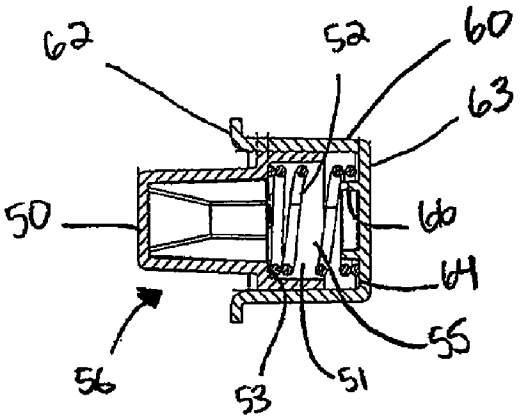
FIG. 4 illustrates a cross-sectional view of the guide/insert assembly of FIG. 3.
Figure 5:
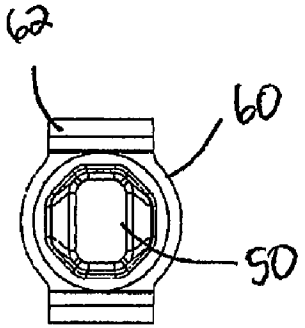
FIG. 5 illustrates a front view of the guide/insert assembly of FIG. 3.

The preferred configuration of the guide 50 is shown in FIGS. 3-5. In the preferred configuration, the guide 50 is comprised of two sections, i.e., a base section 54 and an engaging section 56. The base section 54 and the engaging section 56 are preferably integral with the guide 50, though they may be separate components that are secured together to form the guide 50. The guide 50 preferably has a height of about 1 inch, width of about 1 inch, and depth of about 1½ inches.

The base section 54 of the guide 50 has a chamber 51 for housing the compression spring 52. Preferably the base section 54 has a substantially circular cross section having a diameter that is slightly greater than the diameter of the compression spring 52. Thus, the compression spring 52 will closely fit within the chamber 51 of base section 54 while still being able to move, e.g., to be compressed, with respect to the walls of the base section 54. In order to exert a force on the guide 50, one end of the compression spring abuts a retaining surface 53 within guide 50. The other end of the compression spring 52 extends through an opening 55 at the base section 54 of the guide 50 in order to exert a force on the vent 30, e.g., to bias the vent 30 toward the center of the housing 20.

The engaging section 56 of the guide 50 is the portion of the guide 50 that engages the track 40. As discussed above, in the preferred embodiment the engaging section 56 is shaped to closely fit within the channel 42 of the track 40. Preferably, the engaging section 56 of the guide is generally frustoconical in shape. As shown in FIGS. 3-5, in the preferred embodiment the engagement section 56 has multiple flat sides forming the generally frustoconical shape of the engagement section 56. As shown in FIG. 6, the engaging section 56 of the guide 50 preferably has a profile that is generally trapezoidal in shape, and it contacts three surfaces of the channel 42.

In the preferred embodiment, the guide 50 is coupled with an insert 60 that is generally cylindrical in shape. The inner diameter of the insert 60 is preferably slightly larger than the outer diameter of the base section 54 of the guide 50 to allow for the guide 50 to slide with respect to the insert 60. Preferably, the inner diameter of the insert 60, the outer diameter of the base section 54 and the outer diameter of the compression spring 52 are all around about 1 inch±½ inch, and more preferably about 1 inch. Preferably, the compression spring 52 has a free length of about ¾±1/32 inch and a working length of about ½ inch±1/32 inch. In view of these preferred dimensions, the guide 50 most preferably has a range of motion of about ¼ inch with respect to the side wall 36 of the vent 30. When the guide 50, spring 52 and insert 60 are assembled together, the preferred length of the assembly in an uncompressed state is about 2 inches.

The insert 60 preferably has opposing flanges 62 that help to secure the insert 60 within an opening 37 in the side wall 36 of the vent 30, as shown in FIG. 2. However, the insert 60 may be secured to the side wall 36 using any suitable means, e.g., bolts, rivets or screws. In another embodiment, the insert 60 may be integral with the side wall 36 of the vent 30. In still another alternative configuration, the guide 50 may be operably connected to the side wall 36 without an insert 60. For example, one end of the compression spring 52 could be attached to the guide 50 while the other end could be attached to the side wall 36.

Returning to FIG. 4, the insert 60 has a contact surface 64 that abuts the compression spring 52, i.e., the compression spring 52 exerts a force against the contact surface 64 of the insert 60 when the spring 52 is under a compressive force. As shown, the contact surface 64 is preferably provided by an end wall 63 of the insert 60. Alternatively, the contact surface 64 may be formed on the inner wall 65 of the insert 60, e.g., the insert 60 could be a hollow tube having an inner ring that provides the contact surface 54 for the compression spring 52. See, e.g., FIG. 3.

In the preferred embodiment, the end wall 64 further features a spring retaining wall 66, which is a circular wall sized to fit within the inner diameter of the compression spring 52. The spring retaining wall 66 helps to secure the spring 52 within the guide 50 and the insert 60 and to prevent the spring 52 from becoming misaligned. Alternatively, the spring retaining wall 66 could be in the form of a disc that is sized to fit within the inner diameter of the compression spring 52. The spring 52 may further be secured within the chamber 51, e.g., by an adhesive. In any event, in the preferred embodiment, the proximity of the vent 30 to the track 40 will prevent the guide 50 from separating from the insert 60, which will in turn prevent the spring 52 from falling out of the chamber 51.

Though the cylindrical shape of the base section 54 and the insert 60 is the preferred shape, these components may be any shape suitable for housing the biasing element, e.g., square or hexagonal. However, the cylindrical shape may allow for some rotation of the guide 50 within the insert 60 in response to the movement of the engaging section 56 of the guide 50 through the channel 42, which in turn may provide for a smoother raising/lowering operation. Additionally, the cylindrical shape is congruous with the shape of the preferred biasing element, i.e., the compression spring 52.

Figure 7:
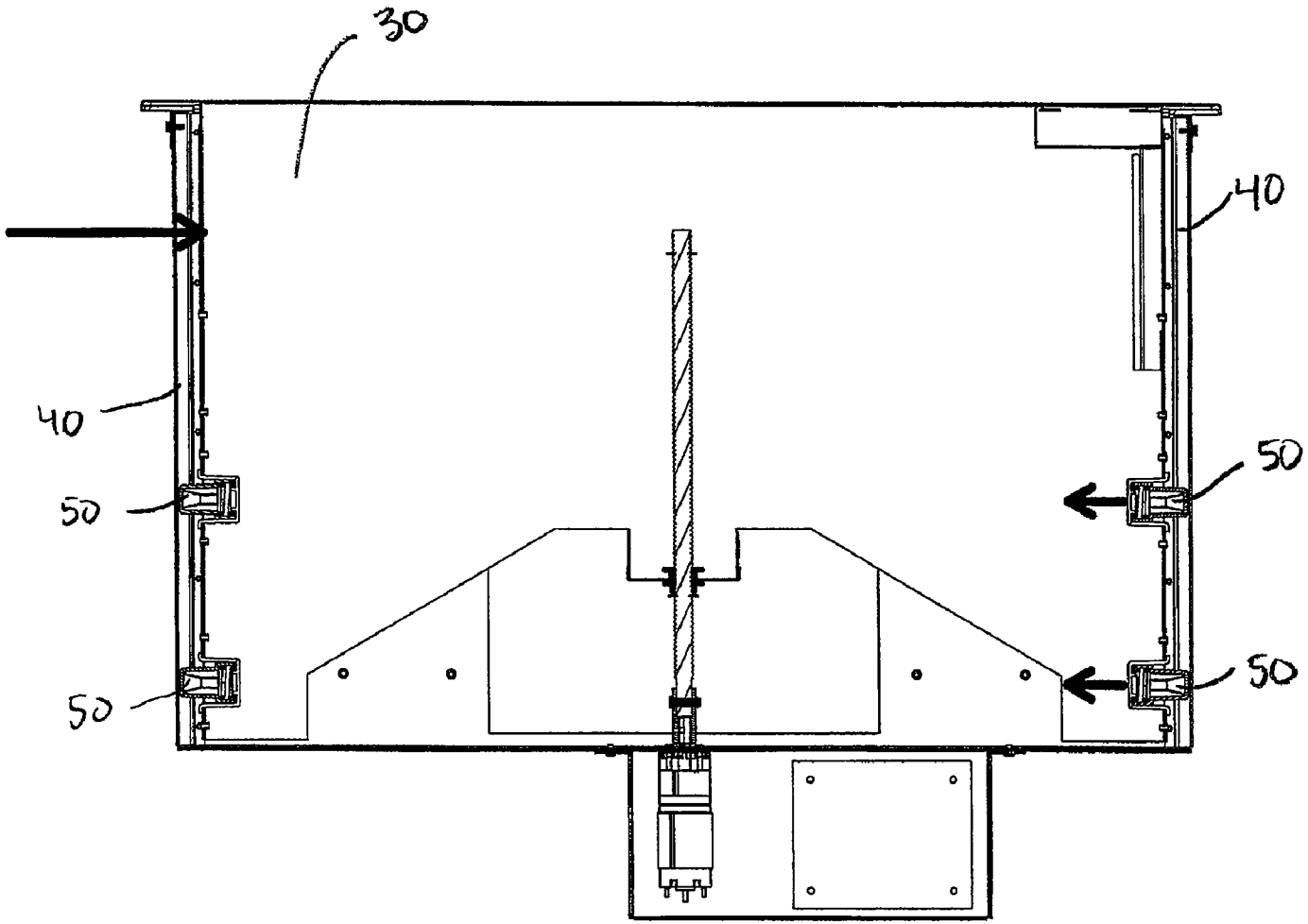
FIG. 7 illustrates a cross-sectional view of the embodiment of FIG. 1B and shows a potential force distribution with respect to the vent.
Figure 9:
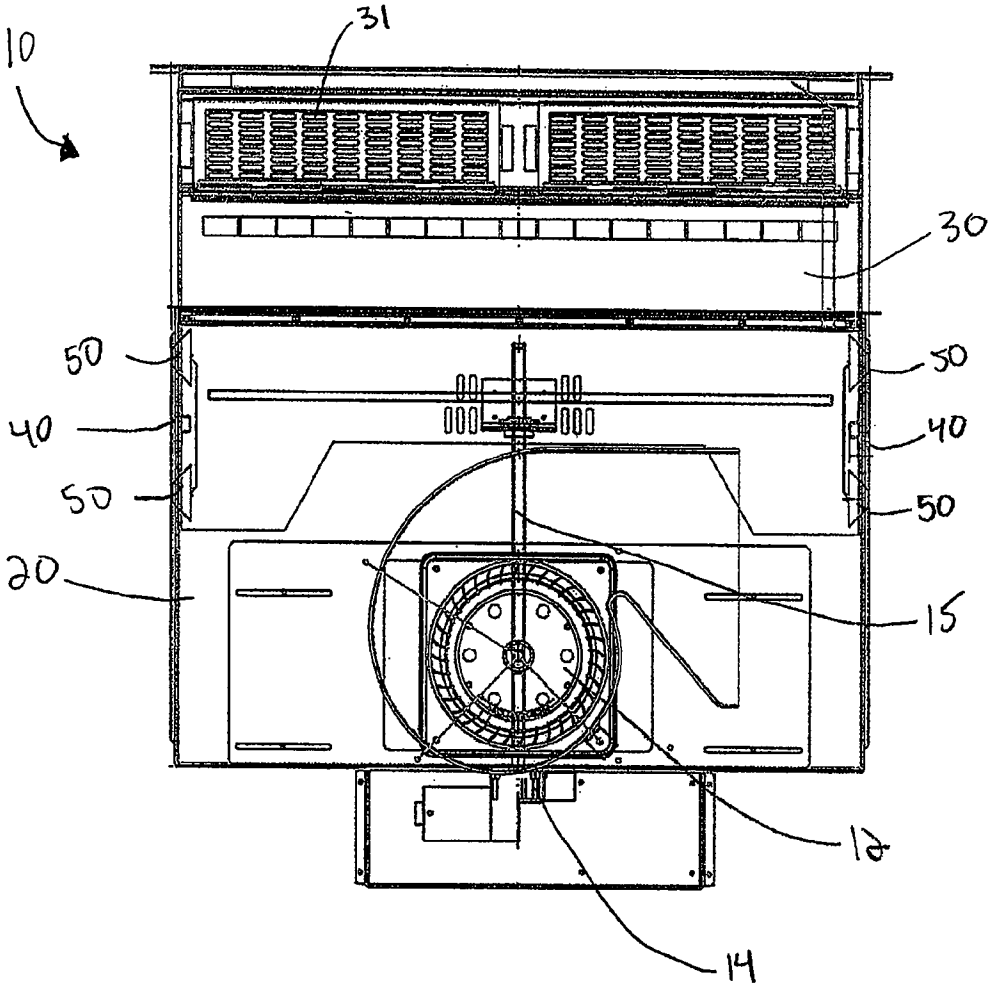
FIG. 9 illustrates a front view with parts removed of the embodiment of FIG. 8, wherein the vent is partially raised above the housing.

Thus, in operation, when a force is exerted on the vent 30, e.g., a force that is generally normal to the side walls 36 of the vent 30, the guides 50 on either side of the vent 30 will move with respect to the inserts 60 causing the compression springs 52 to compress, which biases the vent 30 toward the center of the housing 20 and thus helps center the vent 30 within the housing 20. See FIG. 7, with forces indicated by arrows. The force from the left as shown in FIG. 7 loads the top right spring, but also the bottom left. The moments created resist the side force and help to center the vent 30, particularly when the vent is in motion. When the vent 30 hits the top or bottom stops it will realign itself within the housing 20.

Moreover, for forces that are not substantially normal to the vent 30, the preferred trapezoidal shape of the channel 42 and the frustoconical shape of the engagement section 56 of the guide 50 will help to normalize those forces and center the vent 30 within the housing 20.

If additional pairs of guides 50 are desired, the guides 50 are preferably positioned so that the forces exerted by the compression spring are substantially offsetting, i.e., aligned along a line 72 that is substantially parallel to the tracks. This system may be described as a "floating system."

In another embodiment of the telescoping downdraft ventilator 10 of the present invention (not shown), the position of the guides 50 and the tracks 40 may be switched, i.e., the tracks 40 may be positioned on the side walls 36 or integral with the side walls 36 of the vent 30, and the guides 50 may be positioned on the side panels 26 of the housing 20.

In still another embodiment (not shown), the tracks 40 may be inverted, e.g., the channel 42 forms a ridge that extends toward the vent 30. In such an embodiment, the engaging section 56 of the guide 50 would have a channel contoured to receive the ridge of the track 42.

Figure 8:
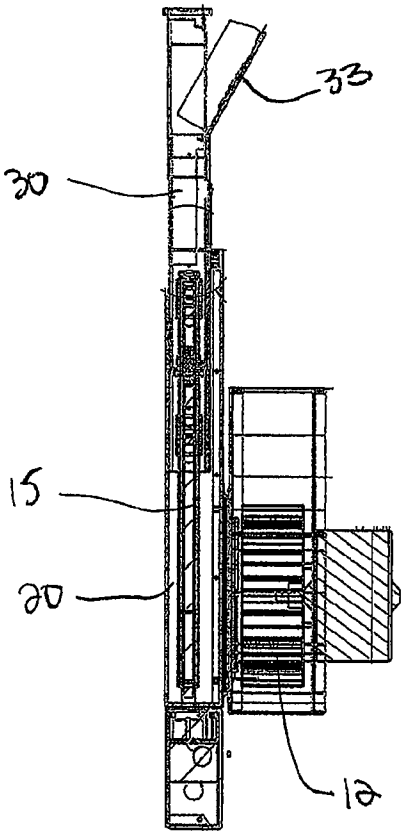
FIG. 8 illustrates a side view with parts removed of another embodiment of a telescoping downdraft ventilator of the present invention.

Turning now to the configuration of the vent, as shown in FIG. 8, the front wall 32 of the vent 30 has intake openings 31 for drawing in air that is proximate the cook top. Preferably, the vent has a tip-out panel 33 to facilitate changing a filter within the vent 30. As shown in FIG. 8, the tip-out panel 33 lifts up and out of the vent so as to allow access to the filter. In the closed position, the tip-out panel 33 is secured with a hook.

As discussed above, the vent 30 is movable with respect to the housing 20, e.g., the vent may be raised above the cook top to remove undesired gases from the cook top when the cook top is in use, and the vent 30 may be lowered when the cook top is not being used. The vent 30 may be raised and lowered manually or preferably with a drive assembly 14, e.g., a motor.

Any one of a variety of known configurations may be used to raise and lower the vent 30. For example, in the preferred embodiment the lift assembly includes a motor 14 having a threaded shaft 15 extending substantially vertically. The shaft 15 engages a nut 16 secured to the vent 30 so that rotating the shaft 15 in one direction raises the vent 30 and rotating the shaft 15 in the other direction lowers the vent 30. In another configuration (not shown), the motor has a threaded shaft that extends generally horizontally and engages a scissor-type linkage for raising and lowering the vent. A further discussion of the scissor-type linkage may be found in U.S. application Ser. No. 11/838,621, the entire contents of which is expressly incorporated by reference herein.

The telescoping downdraft ventilator 10 of the present invention may further include an electronic control system for controlling, for example, the fan 12 and the drive assembly 14, which is discussed in detail in application Ser. No. 11/838,621. The ventilator 10 may further include sensors in communication with the electronic control system for detecting one or more conditions within the vent or housing. For example, a sensor may detect excess load in the drive assembly 14, e.g., caused by an item obstructing either the raising or lowering of the vent with respect to the housing. Preferably, the sensor would stop the drive assembly 14 when detecting a force of about 25 pounds when raising the vent and about 10 pounds when lowering the vent.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended claims.

We claim:

1. A telescoping downdraft ventilator comprising:

a housing having a track;

a vent dimensioned to fit within the housing and movable along a path of travel;

a drive assembly operably coupled with the vent; and a guide attached to the vent for engaging the track, wherein the guide is coupled with a bias element that biases the guide away from the vent and wherein the bias element applies a biasing force on the guide that is perpendicular to the path of travel of the vent;

wherein a) the bias element is a compression spring and the guide has an inner cavity that houses the compression spring;

b) the track has a trapezoidal cross-section and a portion of the guide that engages the track has a trapezoidal cross-section that is sized to be received by the track; and c) the guide is coupled with a retaining member positioned in an opening in the vent so that the guide extends through the opening to engage the track.

2. The telescoping downdraft ventilator of claim 1, further comprising:

a second track within the housing; and a second guide for engaging the second track attached to the vent, wherein the second guide is biased away from the vent.

3. The telescoping downdraft ventilator of claim 2, wherein the tracks are on opposite sides of the housing and are substantially parallel to one another, and wherein the two guides are positioned on opposite sides of the vent.

4. The telescoping downdraft ventilator of claim 3, wherein each of the guides is aligned along a line that is substantially perpendicular to the tracks.

5. The telescoping downdraft ventilator of claim 4, further comprising a third guide and a fourth guide aligned along a second line that is substantially perpendicular to the tracks, wherein the third guide engages the first track and the fourth guide engages the second track.

6. The telescoping downdraft ventilator of claim 5, wherein the third guide and the fourth guide are each coupled with a bias element.

7. The telescoping downdraft ventilator of claim 6, wherein the drive assembly comprises a motor operably connected to a shaft;

wherein the rotation of the shaft causes the vent to move with respect to the housing; and wherein the drive assembly is controlled by an electronic control system

8. The telescoping downdraft ventilator of claim 1 wherein the guide. and the retaining member are made of plastic.

9. A telescoping downdraft ventilator comprising:

a housing;

a vent sized to fit within the housing, wherein the vent is biased toward the center of the housing; and a drive assembly for vertically moving the vent with respect to the housing, wherein the drive assembly moves the vent along an axis that is perpendicular to a biasing force applied on the vent; wherein the biasing of the vent is provided by a compression spring and the compression spring fits into a guide having an inner cavity;

wherein the guide is coupled with a retaining member positioned in an opening in the vent so that the guide extends through the opening to engage a track; and wherein the track has a trapezoidal cross-section that receives a portion of the guide that has a corresponding trapezoidal cross-section.

10. The telescoping downdraft ventilator of claim 9, further comprising:

a pair of substantially parallel tracks on opposite sides of the housing; and a pair of guides on opposite sides of the vent;

wherein each guide engages a respective track; and wherein each guide is coupled with a bias element to bias the guide away from the vent.

11. A telescoping downdraft ventilator according to claim 10, wherein the guides are aligned along a line that is substantially perpendicular to the tracks.

12. A telescoping downdraft ventilator comprising:

a housing having a first track and a second track on opposite sides of the housing, the tracks being substantially parallel to one another;

a vent configured to travel along the first and second track;

a first guide and a second guide attached to opposite sides of the vent, the first guide engaging the first track and the second guide engaging the second track;

wherein the first guide and second guide are aligned along a line substantially perpendicular to the first track and the second track; and wherein each guide is operably coupled with a compression spring that applies a biasing force that is generally perpendicular to the first and the second tracks; and is housed in an inner cavity in the guide;

wherein at least one guide is coupled with a retaining member positioned in an opening in the vent so that the guide extends through the opening to engage a track; and wherein at least a portion of one guide has a trapezoidal cross-section that is sized to be received by a corresponding trapezoidal cross-section in one track.

13. A telescoping downdraft ventilator according to claim 1, further comprising:

a third guide and a fourth guide attached to opposite sides of the vent and aligned along a line substantially perpendicular to the first track and the second track;

wherein the third guide and the fourth guide are each coupled with a compression spring; and wherein the third guide engages the first track and the fourth guide engages the second track.

14. A telescoping downdraft ventilator according to claim 12, wherein the compression springs substantially center the vent within the housing when driven by a drive assembly.

15. A telescoping downdraft ventilator according to claim 12, wherein the downdraft ventilator is controlled by a remote control.

* * * * *